US005890978A

United States Patent [19]

Emig et al.

[11] Patent Number: 5,890,978

[45] Date of Patent: Apr. 6, 1999

[54] RACKET FOR BALL GAMES, IN PARTICULAR TENNIS OR SQUASH RACKET

[76] Inventors: Uwe Emig, Gartenstrasse 29, D-69429 Waldbrunn; Markus Gramlich, Schillerstrasse 2, D-64372 Ober-Ramstadt, both of Germany

[21] Appl. No.: 913,820

[22] PCT Filed: Jan. 18, 1997

[86] PCT No.: PCT/DE97/00085

§ 371 Date: Sep. 25, 1997

§ 102(e) Date: Sep. 25, 1997

[87] PCT Pub. No.: WO97/26951

PCT Pub. Date: Jul. 31, 1997

[30] Foreign Application Priority Data

Jan. 25, 1996 [DE] Germany ..... 196 02 587.7

[51] Int. Cl.[6] ..... A63B 49/02

[52] U.S. Cl. ..... 473/539

[58] Field of Search ..... 473/534, 539, 473/548

[56] References Cited

U.S. PATENT DOCUMENTS

| | | | |
|---|---|---|---|
| 3,884,467 | 5/1975 | Sommer | 473/539 |
| 4,204,681 | 5/1980 | Hall, Jr. et al. | 473/539 |
| 4,681,319 | 7/1987 | Zilinskas . | |
| 4,949,968 | 8/1990 | Korte-Jungermann | 473/539 |
| 5,014,987 | 5/1991 | Soong | 473/539 X |
| 5,257,781 | 11/1993 | Sines et al. | 473/539 |
| 5,368,297 | 11/1994 | Liu | 473/539 |
| 5,516,100 | 5/1996 | Natsume | 473/539 X |

FOREIGN PATENT DOCUMENTS

| | | |
|---|---|---|
| 904 333 | 6/1986 | Belgium . |
| 41 10 698 | 10/1992 | Germany . |
| 42 03 682 | 8/1993 | Germany . |
| 91 12857 | 9/1991 | WIPO . |

*Primary Examiner*—William E. Stoll

*Attorney, Agent, or Firm*—Nikaido, Marmelstein, Murray & Oram LLP

[57] ABSTRACT

In a tennis racket with a frame (1) forming the striking head and a tensioning system consisting of crossed strings, where the strings (7) are secured by being passed through apertures in a frame component (2) and a component supported by the frame component (2), and where at least one securing device for at least one string (7) is designed in such a way that the string (7) can move on the inside of the frame in a direction perpendicular to the tension plane formed by the tensioning system, at least one dimensionally stable component (10) surrounding the movable string (7) like a sleeve can move to a limited extent in relation to the frame section (2) radially to the longitudinal axis of the string (7) and is supported on a body (12) which is arranged in a recess in the frame section (2) and is made of an elastomeric material which can be deformed by a movement of the component (10).

8 Claims, 3 Drawing Sheets

RACKET FOR BALL GAMES, IN PARTICULAR TENNIS OR SQUASH RACKET

BACKGROUND OF THE INVENTION

This invention relates to a racket for ball games, in particular a tennis or squash racket, comprising a frame forming a racket head and a racket handle, and a stringing formed by intersecting lengths of string attached to a frame part constituting the racket head, in which, for the purpose of fastening the strings, the lengths of string are passed through openings in the frame part, and from the frame inside to the frame outside in an element taking support on the frame part, and through further openings in the frame part, and from the frame outside to the frame inside in an element taking support in the frame part, and in which for at least one length of string at least one string fastening structure is configured in such a fashion that this particular length of string is movable on the frame inside in a direction perpendicular to the plane formed by the stringing.

A racket of the type initially referred to is known from DE 42 03 682 A1. In this known racket, the element serving as a string fastening means is configured as a sleeve manufactured from a rubber-like material and inserted into the two openings in the frame part such as to rest with a bridge-type widened section thereof against the frame outside, while its sleeve-type section which tightly encloses the threaded-through portion of the string is snugly received within the opening provided in the frame outside. The opening in the frame inside is configured as an elongated hole extending normal to the plane of the stringing, thereby enabling the sleeve, together with the string length, to deflect in the area of this opening into a direction perpendicular to the plane of the stringing. Owing to the possibility of motion of part of the stringing on the frame inside thus provided, an increase in the effective impact area is accomplished, because the length of movement of the stringing is increased by the distance between the frame inside and the frame outside. Further, an improved playing comfort and damping action is claimed to be realizable Still further, for the purpose of damping the ball impact effect, it is known to pass the eight central longitudinal strings of the stringing of a tennis racket through a plastic core carried in a vibration-damping material on the yoke of the frame part constituting the racket head. This arrangement does not, however, provide for movability of the longitudinal strings on the frame inside.

OBJECT AND SUMMARY OF THE INVENTION

It is an object of the present invention to improve upon the playing properties of a racket of the type initially referred to and to enable the playing properties to be adapted for a variety of more specific requirements.

According to the present invention, this object is accomplished in that at least one dimensionally stable element encompassing the movable string length in the manner of a sleeve is mounted so as to be movable within limits relative to the frame part in a radial direction to the longitudinal axis of the string length and bears against a member arranged in a recess in the frame part and made of an elastomeric material that is deformable by a movement of the element.

In the racket of the present invention, at least one, but preferably a plurality of string fastening structures is configured such that the individual string lengths, under the action of a ball striking the stringing of the racket, are capable of executing a sufficient movement on the frame inside, with the order of magnitude of this movement as well as of the ensuing counter-movement being controlled by the elastomeric member. In this manner, the dynamic response of the stringing can be significantly improved by means of the elastic member in the sense of an improvement of the playing properties, particularly with respect to ball control, in addition to enabling the vibration response of the strings to be influenced in a lasting way by coupling the movable elements to the elastomeric member in the sense of a reduction of the load exerted on the arm and an improvement of the playing comfort. By reason of the variation, size and shape of the movable element and the elastic properties of the elastomeric member, the racket of the present invention affords an added possibility to adapt the playing properties to individual requirements and to react in an appropriate manner to different properties of string materials.

The racket of the present invention further has the advantage that the movability of the strings on the frame inside with a given racket size results in an increase in the effective impact zone and in a higher ball acceleration, while at the same time ball control is improved. When the ball hits the peripheral area of the effective impact zone, the torsional strain to which the racket handle is exposed is reduced, resulting in a reduced strain on the player's wrist. By reducing the vibrations of the strings, the so-called rebound shock is mitigated, accordingly reducing the trampoline effect thereby produced, which results in particular in less elbow strain. With the racket configuration of the present invention, the stiffness of the frame head in the longitudinal and transverse direction is maintained, so that the stresses, strains and loads to which the frame is exposed have no adverse effect on ball acceleration and ball control.

According to a further aspect of the present invention, the element may be carried in a universally movable pivot bearing on the frame part. Another supporting possibility provided by the present invention is that the element is embedded exclusively within the elastomeric member, with a space being provided between the element and the frame part on all sides. In this configuration, there is thus no location where the movable element is in direct contact with the frame part.

According to another aspect of the present invention, at least two adjacent elements may be connected with each other by means of a bridge member. This connection may be configured as a rigid or as a movable connection. Still further, two elements arranged on the common loop of two lengths of string may bear against each other directly. By this arrangement, the forces tending to pull the loop together can be taken up by the elements bearing against each other, keeping them away from the frame part.

In another advantageous feature of the racket of the present invention, the string length may take support upon the movable element such that the tensile stress is transmitted through the element and the elastomeric member to the frame part. This is particularly effective in reducing the transmission of string vibrations to the frame, in addition to affording movability of the string fastening structure in the longitudinal direction of the string. According to the present invention, the inner contour of the frame part and the outer contour of the element may be conformed to each other, such that a space of approximately like width is produced in which the elastomeric member is arranged.

The racket of the present invention may be manufactured in a variety of ways. For example, the element may be introduced into the frame part before the frame receives its final shape, the element being then non-releasably located in the interior of the frame part. Fitting the element after manufacture of the frame is complete can be accomplished according to the present invention simply in that the element is comprised of a sleeve encompassing the string length, and of a plate or disk with an opening snugly receiving the sleeve.

BRIEF SUMMARY OF THE DRAWINGS

Embodiments of the present invention will be described in more detail in the following with reference to the accompanying drawings. In the drawings.

DETAILED DESCRIPTION OF PREFERRED EMBODIMENTS

Figure 1:
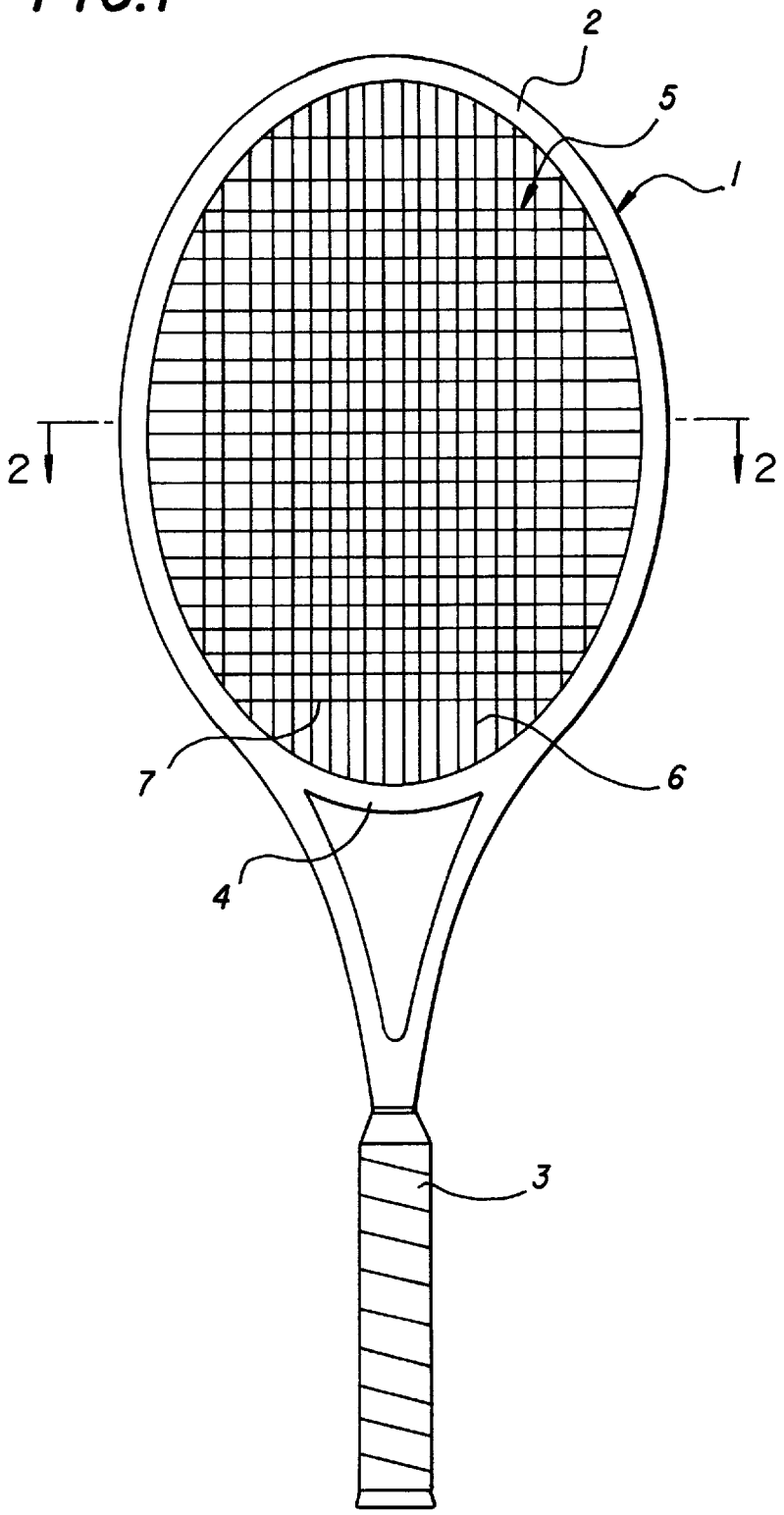
FIG. 1 is a top plan view of a tennis racket.

The tennis racket shown in FIG. 1 is comprised of a loop-shaped frame 1 formed by a racket head 2 and a racket handle 3. The oval ring of the racket head 2 is closed by a yoke 4 inserted into the frame 1 at the end close to the handle 3. A stringing 5 comprised of intersecting string lengths 6, 7 is provided within the oval ring of the racket head 2. The string lengths 6 extend parallel, and the string lengths 7 normal, to the longitudinal axis of the racket head 2.

Figure 2:
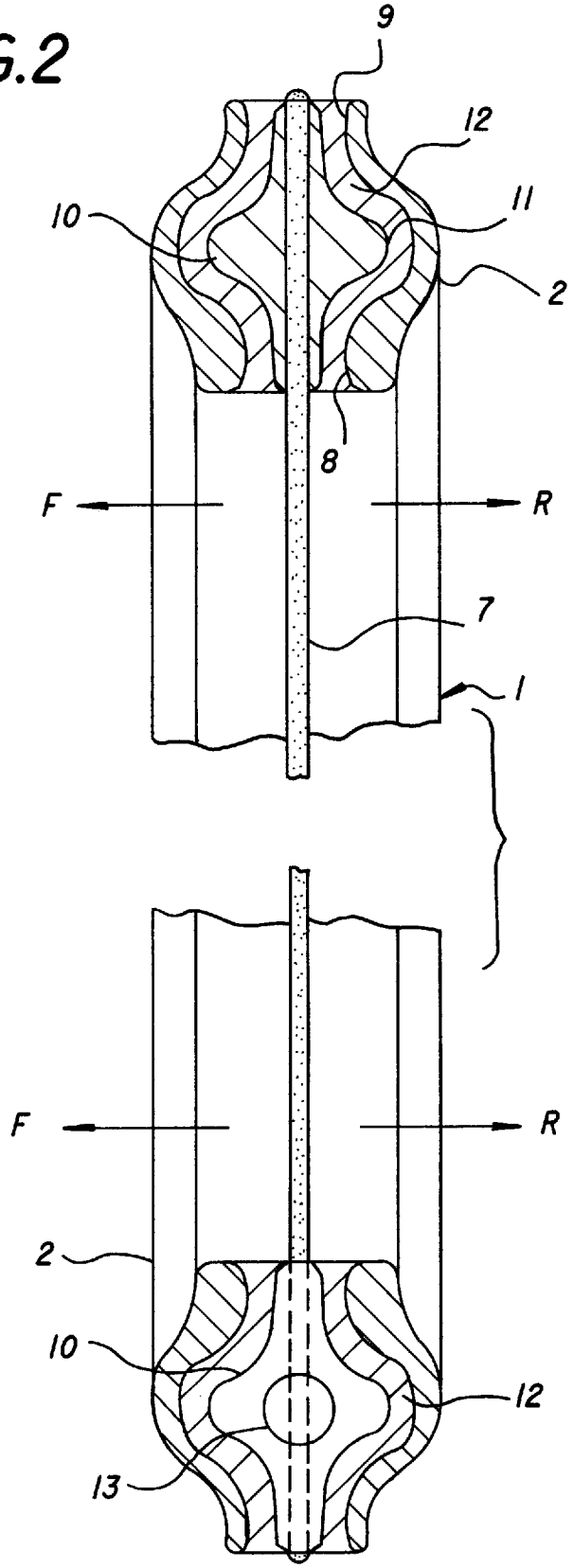
FIG. 2 is a cross-sectional view of the tennis racket of FIG. 1, taken along the line A—A of the tennis racket of FIG. 1.

As shown in FIG. 2, in the area of the racket head 2, the frame 1 is configured as a tubular hollow body fabricated from a fiber reinforced plastic. The frame 1 has on its inside and outside openings 8, 9 spaced uniformly apart through which strings forming the stringing 5 are passed from the inside to the outside at one location, and from the outside to the inside at another location, thereby producing loops on the frame outside whereby the string lengths 6, 7 extending within the frame 1 are held. The center string lengths 6, 7 arranged in the effective impact zone referred to as the sweet spot have their fastening ends within the frame 1 passed through sleeve-shaped elements 10 encompassing with their bore the fastening end of the associated string length 6, 7 with a nearly snug fit. The elements 10 are made of a dimensionally stable plastic material or metal. The outer contour of the elements 10 is conformed to the inner contour of the cavity inside the frame 1, with the outer dimensions of the elements 10 being substantially smaller than the inner dimensions of the cavity. The cavity is substantially oval in cross-section within the racket head 2. The openings 8, 9 are arranged on the broad sides of the oval cross-section. The transitions between the openings 8, 9 and the cavity are radiused. Corresponding to this cross-sectional shape of the cavity, the elements 10 have in their center area a thickened portion 11 extending in the radial direction in relation to the sleeve bore. A member 12 made of an elastomeric material encompassing the elements 10 on all sides is provided in the space between the elements 10 and the cavity of the frame 1 including the openings 8, 9. The elements 10 of adjacent string lengths 7 bear against each other. To this effect, the elements 10 have at their ends extending in the longitudinal direction of the cavity short cylindrical extensions 13 providing the abutting relationship.

When the string length 7 illustrated in FIG. 2 is moved in the direction of the arrows F due to the impact of a ball, this movement is transmitted to the elements 10, causing the elements to execute with their radially inner ends a movement in the same direction, correspondingly deforming the elastomeric-member 12 in the process. The amount of movement of the elements 10 is determined by the selected stiffness of the member 12. The counter-movement of the string length 7 in the direction of the arrows R is initially assisted by the relaxation of the member 12, and is subsequently slowed down by another deformation of the member 12 in the opposite direction. Overall, the movement of the string length 6, 7 is thus influenced, producing the advantageous effects initially referred to.

Figure 3:
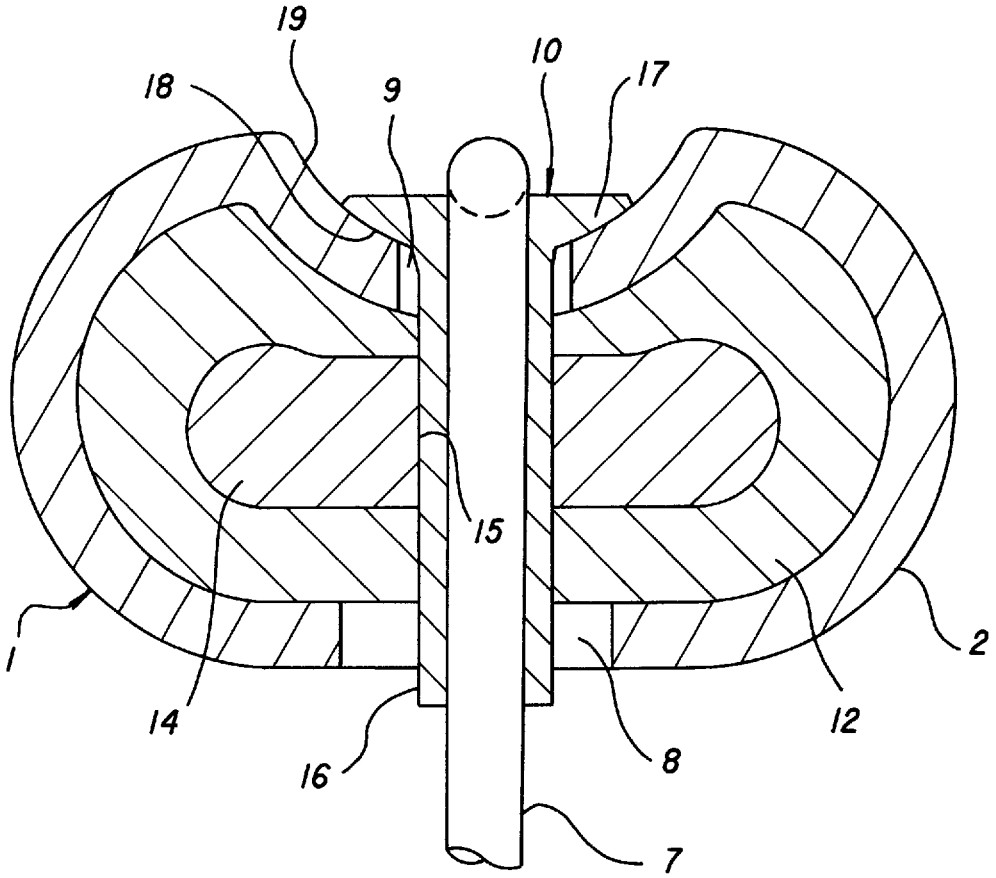
FIG. 3 is a cross-sectional view of another embodiment of a string fastening structure of the present invention.

The embodiment illustrated in FIG. 2 requires the elements 10 to be introduced into the frame 1 as the frame is manufactured, before the frame 1 receives its final shape. In contrast thereto, the embodiment of FIG. 3 enables the elements 10 to be fitted into the frame 1 following frame manufacture. To this end, the elements 10 are comprised of a round disk 14 having a central passage bore 15 and a sleeve 16 insertable into the bore 15 from outside by passing it through the opening 9 in the frame 1. At its end close to the frame outside, the sleeve 16 includes a flange 17 with an engagement surface 18v in the shape of a spherical segment carried by a cylindrical bearing surface 19 on the frame outside in this manner, simple means provide a universally movable pivot bearing for the sleeve 16, enabling the end of the sleeve 16 close to the frame inside to move freely within the opening 8 in any direction. Any movement of the sleeve 16 is transmitted to the disk 14 and influenced in the manner previously described by the deformation forces of the elastomeric member 12.

What is claimed is:

1. A racket for ball games comprising:

a frame forming a racket head and a racket handle, the racket head having a frame part, a stringing formed by intersecting lengths of string attached to the frame part and defining a plane, the frame part having an interior recess and a plurality of inside openings and a plurality of matching outside openings in the plane and positioned at opposite sides of the recess, the lengths of string being strung through the inside and outside openings in the frame part from an inside surface of the frame to an outside surface of the frame and from the outside surface of the frame back to the inside surface of the frame, a portion of each of the lengths of string in the plane being movable in a direction perpendicular to the plane formed by the stringing, an elastic member arranged in the recess of the frame part, and a plurality of sleeve elements, each sleeve element encompassing a part of the movable string length, the sleeve elements being mounted to be movable within limits relative to the frame part in a radial direction with respect to a longitudinal axis of the string length and bearing against the elastic member arranged in the recess in the frame part, the sleeve elements being made of a dimensionally stable material, the member being made of an elastomeric material deformable by a movement of the sleeve element.

2. The racket as claimed in claim 1, wherein the frame part further includes a cylindrical bearing surface on the outside surface and the sleeve element comprises a round disc having a central bore and being encased in the elastic element, and a sleeve inserted into the bore and having a flange with an engagement surface pivotally engaging the cylindrical bearing surface of the frame part.

3. The racket as claimed in claim 1, wherein the sleeve element is embedded completely within the elastomeric member, with a space being provided between the sleeve element and the frame part on all sides.

4. The racket as claimed in claim 1, wherein at least two adjacent sleeve elements are connected with each other by a bridge member.

5. The racket as claimed in claim 1, wherein two adjacent elements bear against each other directly.

6. The racket as claimed in claim 1, wherein the string length is supported by the movable sleeve element such that tensile stress is transmitted through the sleeve element and through the elastomeric member, to the frame part.

7. The racket as claimed in claim 1, wherein an inner contour of the frame part and an outer contour of the sleeve element conform to each other, such that a space is defined between the outer contour of the sleeve element and the inner contour of the frame part, the space being of approximately equal width around the entire sleeve element.

8. The racket as claimed in claim 1, wherein the sleeve element is comprised of a sleeve encompassing the string length, and a plate or disk with an opening snugly receiving the sleeve.

* * * * *